United States Patent [19]

Lissau

[11] 4,309,781

[45] Jan. 12, 1982

[54] AUTOMATIC FLUSHING SYSTEM

[75] Inventor: Frederic Lissau, Chicago, Ill.

[73] Assignee: Sloan Valve Company, Franklin Park, Ill.

[21] Appl. No.: 148,402

[22] Filed: May 9, 1980

[51] Int. Cl.[3] ..... E03D 13/00

[52] U.S. Cl. ..... 4/304; 4/305; 4/623; 4/DIG. 3

[58] Field of Search ..... 4/DIG. 3, 623, 304, 4/302, 305, 313

[56] References Cited

U.S. PATENT DOCUMENTS

| | | | |
|---|---|---|---|
| 1,441,007 | 1/1923 | Littlefield | 4/305 |
| 1,532,905 | 4/1925 | Lawler | 4/302 |
| 2,373,697 | 4/1945 | Littlefield | 4/305 X |
| 2,603,794 | 7/1952 | Bokser | 4/304 |
| 2,738,448 | 3/1956 | Bokser | 4/304 X |
| 3,151,340 | 10/1964 | Teshima | 4/623 X |
| 3,239,847 | 3/1966 | Parri | 4/305 X |
| 3,305,938 | 2/1967 | Goldstein | 34/44 |
| 3,358,747 | 12/1967 | Lesher et al. | 4/DIG. 3 |
| 3,471,868 | 10/1969 | Zorn | 4/304 |
| 3,482,268 | 12/1969 | Teshima | 4/304 |
| 3,555,368 | 1/1971 | Atkins | 4/304 |
| 3,576,277 | 4/1971 | Blackmon | 4/305 |
| 3,585,652 | 6/1971 | Forbes et al. | 4/304 |
| 3,593,073 | 7/1971 | Atkins | 4/304 |
| 3,648,298 | 3/1972 | Gross | 4/305 |
| 3,670,167 | 6/1972 | Forbes | 4/304 X |
| 3,811,410 | 5/1974 | Roberts | 4/304 X |
| 3,863,196 | 1/1975 | Hilles | 4/304 X |
| 4,141,091 | 2/1979 | Pulvari | 4/313 |

*Primary Examiner*—Henry K. Artis

*Attorney, Agent, or Firm*—Kinzer, Plyer, Dorn & McEachran

[57] ABSTRACT

An automatic flushing system having an electrically-operated flush valve, a sensor for determining the presence of a person and a control circuit responsive to the sensor for initiating the operation of the flush valve. The sensor emits pulses from within a defined viewing area. A lens system is arranged to collect reflected light only from the defined viewing area. Light reflected from walls, tile or other shiny surfaces does not activate the control circuit. The sensor is mounted below and behind the flush valve actuating means so as to be partially hidden from view and thus discourage tampering with the sensor.

5 Claims, 7 Drawing Figures

AUTOMATIC FLUSHING SYSTEM

SUMMARY OF THE INVENTION

This invention is concerned with automatic flushing systems and in particular with sensing means for controlling such systems.

A primary object of the present invention is a control for an automatic flushing system which has greater resistance to false activation.

Another object is an automatic flushing system which is not activated until a person leaves a defined viewing area.

Another object is an automatic flushing system which is not activated by reflected ambient light.

Another object is an automatic flushing system which is not activated by randomly passing objects.

Another object is an automatic flushing system which allows servicing of the flush valve without disburbing the electrical components.

Another object is an automatic flushing system wherein the sensor is substantially hidden from view from above so as to discourage tampering with the sensor.

Other objects will appear in following specification, drawings and claims.

DESCRIPTION OF A PREFERRED EMBODIMENT

The present invention relates to controls for automatic flushing and other applications in the plumbing field. While the following description will be directed to automatic flushing systems, the control of the present invention could also be applied to other plumbing fixtures such as hand dryers.

Those involved in the public health field have long been aware of the sanitation advantages of automatic flushing systems. Such systems include those operated by a timing device which periodically activates a flushing system. These types of systems are satisfactory in high-use facilities but they tend to waste water by flushing more often than is necessary in lower use facilities. Systems which respond only to the presence of an individual have had the drawback of being subject to false operation. That is, the systems operate when there is no need because they are activated by room lights, reflected light and momentarily passing people. The present invention is constructed to reduce false activation due to stray light and momentary presence of people.

Figure 1:
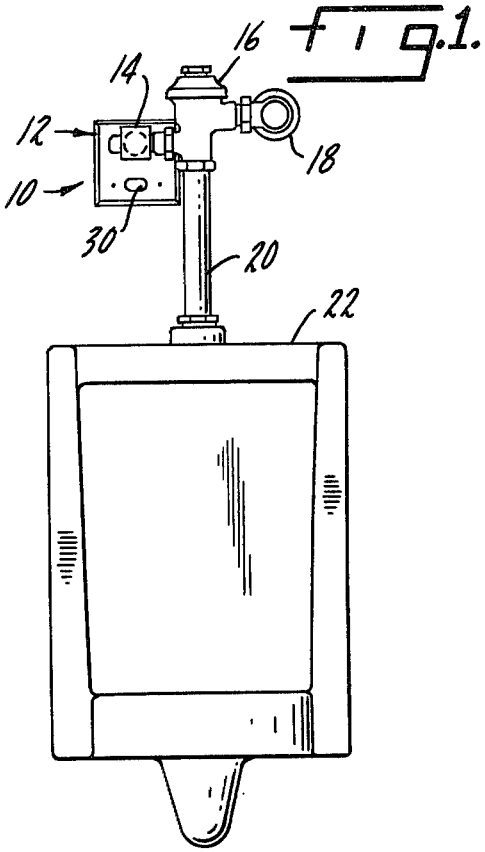
FIG. 1 is a front elevation view of a urinal with the automatic flushing system of the present invention installed thereon.

The control unit of the present invention is shown generally at 10 in FIG. 1. The unit includes a control box 12 which contains the control unit. The output of the control unit is fed to a solenoid 14. Actuation of the solenoid 14 operates the flush valve 16. The flush valve is connected to a water inlet pipe 18 and an outlet pipe 20 which in turn is connected to a urinal 22.

Figure 2:
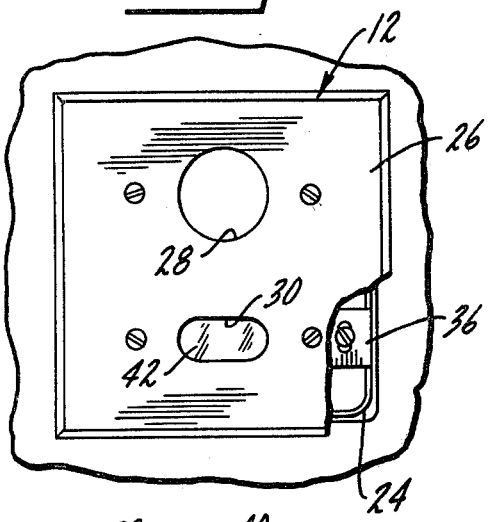
FIG. 2 is an enlarged, front elevation view of the control box, with a portion of the coverplate cut away.

The control box is shown in greater detail in FIG. 2. The box itself comprises a standard-sized receptacle 24 such as a standard 4-inch conduit box. The front of the box is enclosed by a cover-plate 26 which has openings 28 and 30 therein. The opening 28 accommodates a conduit (not shown) through which wires extend from the control unit to the solenoid 14. The opening 30 allows light in and out of the control box. The structure and location of the control box allow servicing of the flush valve without disturbing any electrical components in the control box.

Figure 4:
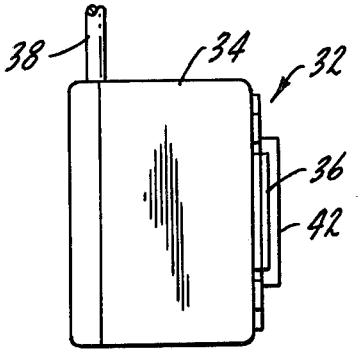
FIG. 4 is a side elevation view of the control unit housing of FIG. 3.
Figure 3:
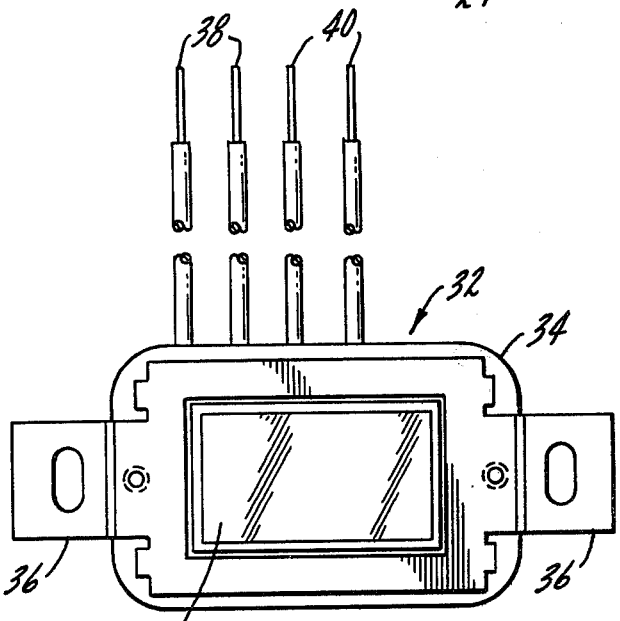
FIG. 3 is a front elevation view of the control unit housing.
Figure 5:
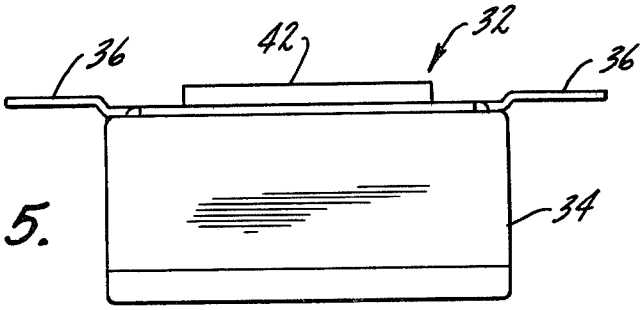
FIG. 5 is a bottom plan view of the control unit housing.

An electrical circuit which performs the control functions may be conveniently housed in the control unit 32 shown in FIGS. 3, 4 and 5. The control unit includes a housing 34 which is designed to fit in the standard receptacle box 24. The housing has a pair of brackets 36 for securing the control unit within the receptacle box. Lead wires 38 are provided for supplying power to the control unit. Lead wires 40 supply power and the control signal to the solenoid 14. At the front central portion of the housing 34 is an opening which is covered by a dark red plastic filter 42. The filter is located in front of the optical devices contained within the housing. These devices will be explained below. When the control unit 32 is placed in the control box 12 the filter 42 is located behind the opening 30 in the cover plate 36.

Figure 6:
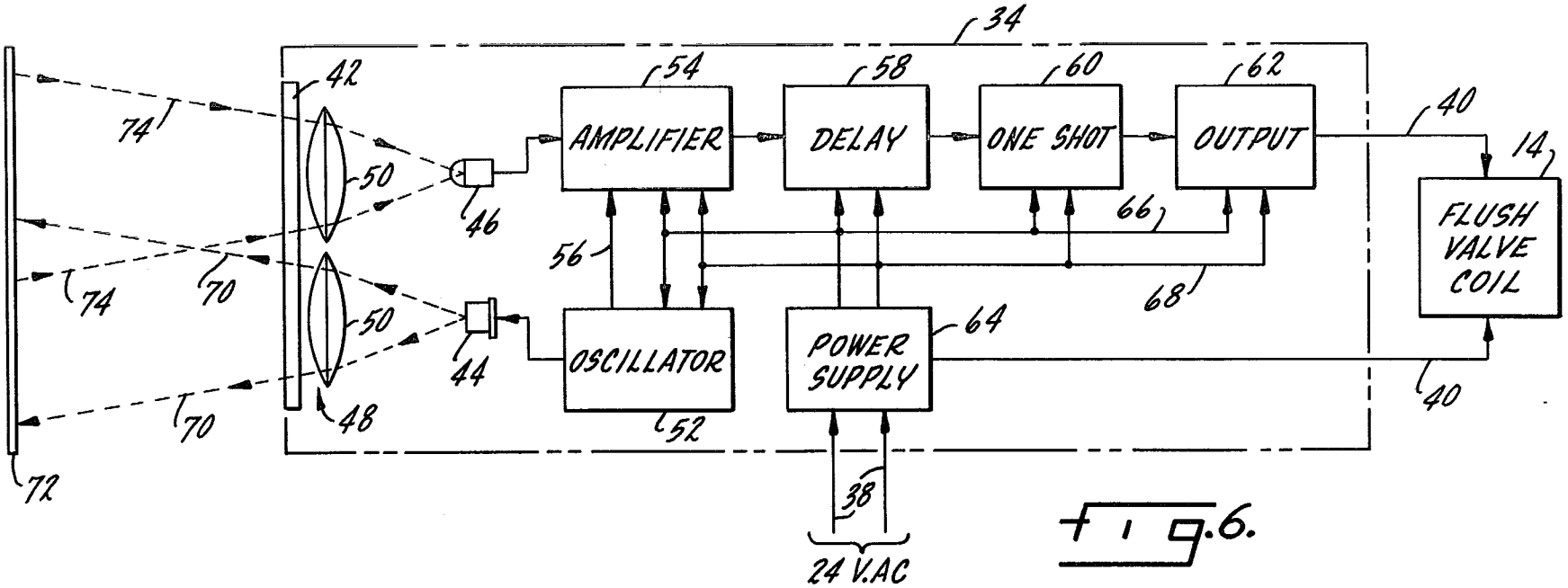
FIG. 6 is an electrical schematic of the control circuit.
Figure 7:
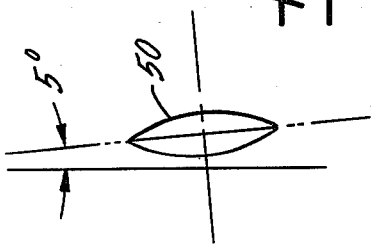
FIG. 7 is a schematic, side elevation view showing the attitude of a lens used in the control circuit of the present invention.

The control circuit is shown schematically in FIG. 6. The circuit includes a light source 44 which is preferably an LED which emits infrared light. The control circuit also includes a photosensor 46. Both the light source 44 and photosensor 46 are mounted within the control unit housing 34 which is in turn mounted in the control box 12. A lens system 48 is mounted between the filter 42 and the light source 44 and photosensor 46. In a preferred embodiment this lens system comprises two convex lenses 50, one in front of both the light source and photosensor. As shown in FIG. 7 the axis of the lens is tilted 5° from vertical. This arrangement of the lenses prevents focusing on the photosensor of reflected light from shiny, vertical surfaces, e.g. walls and doors. Thus false activation due to reflection from tile surfaces and the like is greatly reduced. While 5° has been found to be a suitable lens tilting angle, it will be understood that other arrangements are possible and the invention is not to be limited specifically to a 5° tilt.

Returning now to the circuit of FIG. 6, the operation of the light source 44 is governed by an oscillator 52. An amplifier 54 receives a synchronizing input signal through strobe line 56 from the oscillator. This will be more fully explained below. The amplifier includes an integrator which aids in making the sensing unit immune to ambient light.

The output of the amplifier is fed to an RC type time delay 58. When the time delay times out it feeds a signal to a one shot arming circuit 60. This circuit prepares an output stage 62 in a manner which will be described below. The oscillator 52, amplifier 54, time delay 58, arming circuit 60 and output stage 62 receive power from a power supply 64 through lines 66 and 68. The power supply is a 24 volt AC half wave rectified source.

The DC output is 24 VDC. The power supply also operates the flush valve solenoid 14 through line 40.

The use, operation and function of the present invention are as follows:

The oscillator 52 output is a narrow pulse to the LED light source 44. The light source operates in the infrared range and emits light as shown schematically by rays 70. When no one is standing in a defined viewing area there is no light reflected back to the photosensor 46. As discussed above, ambient light and infrared pulses reflected from walls and/or doors are not focused on the photosensor due to the tilting of the lens system 48. The internal integrator circuit of the amplifier 54 also serves to prevent false activation due to ambient light. The integrator circuit requires so many pulses to charge up that individual pulses which may reach the photosensor are not sufficient in number to initiate the flushing action. Further protection against false activation is afforded in that the amplifier 54 is inhibited when no pulse is provided from the oscillator 52. The amplifier is activated through strobe line 56 to synchronize the amplifier with the oscillator. Thus the amplifier is active only at such times as there is a possibility of a pulse from the light source being reflected to the photosensor.

When a body is present in the defined viewing area in front of the control box the circuit operates as follows. The oscillator 52 causes the LED light source 44 to emit light rays 70 as described above. The body, which is shown schematically at 72 causes reflection of these light rays, the reflected rays being illustrated at 74. The reflected rays return through the lens to the photosensor 46. When the amplifier integrator circuit is charged the time delay 58 begins operation. If the body 72 remains in front of the control box for approximately 6 seconds the time delay will time out. At the end of the delay the one shot or arming circuit 60 fires with a 1 second pulse. This arms the output stage 62 in preparation for operating the solenoid 14. When the body moves away from the viewing area the beam of reflected light to the photosensor is broken and the output stage 62 sends a signal to the flush valve coil which them operates the flush valve. The circuit automatically resets and is immediately ready for the next cycle.

The width of the defined viewing area depends on the size of the opening 30 in the control box cover. The range of the viewing area will depend on the strength of the LED light source. A practical maximum range has been found to be 30±3 inches. Signals reflected from beyond this range by walls or the like do not consistently reach the photosensor 46 because of the angle of lenses 50.

The automatic flushing system of FIG. 1 is mounted in an arrangement which will discourage tampering with the sensing means. The opening 30 in the control box cover is located such that an adult user of average height will not see it. The opening typically will be essentially flush with a wall whereas the solenoid 14, valve 16 and pipes 18 and 20 will, of course, be in front of the wall. So the opening 30, and hence, the sensing means, will be behind the other components of the flushing system. Further, the sensing means is positioned below the solenoid to allow light in and out. But the solenoid acts in the nature of a hood or canopy to shield the sensing means from the normal line of sight of most users. That is, an adult of at least average height would look at the sensing means from above it but that angled line of sight is obstructed by the solenoid 14. Thus, most users will not be aware of the sensing means. This will aid in discouraging tampering with the sensing means. A possible alternate arrangement would be to place the sensing means below and behind the inlet pipe 18.

Whereas a preferred form of the invention has been shown and described it will be realized that there may be many modifications, substitutions and alterations thereto.

I claim:

1. An automatic flushing system comprising:

an electrically operated flush valve;

a control box;

a light source mounted in said control box;

a photosensor mounted in said control box adjacent said light source;

a lens system located in said control box, said lens system comprising spaced convex lenses, one positioned in front of said light source and one positioned in front of said photosensor, said lenses being arranged to focus on said photosensor only light from said light source reflected from an object operatively adjacent said light source;

a cover plate for said control box, said cover plate having an opening therein in register with said lenses;

a control circuit in said control box responsive to said photosensor and connected to said flush valve for initiating operation of said flush valve;

said control circuit including a time delay which inhibits operations of the flush valve until reflected light is sensed by said photosensor for a preselected time period.

2. The structure of claim 1 wherein the control circuit further includes an amplifier for amplifying signals form the photosensor.

3. The structure of claim 2 wherein the control circuit operates the light source intermittently and synchronizes operation of said amplifier so that the amplifier is operating only such times as there may be reflected light from the light source present at the photosensor.

4. The structure of claim 1 wherein the defined viewing area extends substantially thirty inches in front of the light source.

5. The structure of claim 1 wherein the axis of each lens is tilted 5° from vertical.

* * * * *